US005186301A

United States Patent [19]

Rivera

[11] Patent Number: 5,186,301

[45] Date of Patent: Feb. 16, 1993

[54] ISOLATION OF ESCALATOR STEP TREAD

[75] Inventor: James A. Rivera, Bristol, Conn.

[73] Assignee: Otis Elevator Company, Farmington, Conn.

[21] Appl. No.: 924,268

[22] Filed: Aug. 3, 1992

[51] Int. Cl.[5] ..... B66B 23/12

[52] U.S. Cl. ..... 198/333

[58] Field of Search ..... 198/333

[56] References Cited

U.S. PATENT DOCUMENTS 2,152,795 4/1989 Dunlop ..... 198/333

4,295,556 10/1981 Saito et al. ..... 198/333

4,362,232 12/1982 Saito et al. ..... 198/333

FOREIGN PATENT DOCUMENTS 0041378 3/1977 Japan ..... 198/333

*Primary Examiner*—Joseph E. Valenza

*Assistant Examiner*—Cheryl L. Gastineau

*Attorney, Agent, or Firm*—William W. Jones

[57] ABSTRACT

The escalator step has a frame made from metal, and a tread board of metal carried on the frame. The tread board is completely isolated from vibrations imparted to the frame by means of an elastomeric vibration damping material such as rubber which prevents the tread board from directly contacting the frame. The exposed riding surface of the tread board on which passengers stand is metal and is preferably cleated for safety purposes.

2 Claims, 1 Drawing Sheet

ISOLATION OF ESCALATOR STEP TREAD

TECHNICAL FIELD

This invention relates to the step structure of an escalator or moving walkway, and more particularly to a step structure which has a passenger-bearing tread board that is isolated from vibrations imparted to the remainder of the step.

BACKGROUND ART

Passenger comfort is a primary goal of producers of escalators and moving walkways. Comfort-disturbing factors inherent in escalator and moving walkway systems include noise, vibration and heat. The industry has long been attempting to quiet these passenger conveyors, both in the sense of quieting noise and quieting vibrations, both of which when successfully suppressed will result generally in a lessening of heat generated by the devices. To this end, these conveyors have been provided with step rollers having rubber treads; axle mounting bearings which are elastomeric; drive chain links which have elastomeric sleeves where they engage the steps; and handrail guide rails with low coefficient of friction guide tracks on them to lessen heat and noise. U.S. Pat. No. 2,152,795 granted Apr. 4, 1939 to J. Dunlop discloses a moving stairway wherein vibrations imparted to the step are damped by means of rubber bushings mounted on the step axles.

DISCLOSURE OF THE INVENTION

This invention relates to an escalator or moving walkway step assembly wherein the passenger carrying treads are isolated from the remainder of the step components by a rubber or other elastomeric material pad. The majority of the step assembly is made of metal such as aluminum, but the tread board is not formed unitary and in one piece with the remainder of the step, as is commonly the case. The step of this invention has a metal frame to which is connected the step chain and trailer axles and their attendant rollers. The axles may be connected to the frame via rubber bushings as described in the above-noted Dunlop patent. The rollers may include rubber treads to lessen track-to-roller vibrations. The top of the frame is recessed so as to receive a separate tread board member. The tread board nests into the frame recess and is fastened to the frame by means of bolts or the like. An elastomeric pad is also nested into the frame recess and is sandwiched between the tread board and the frame so as to completely isolate the tread board from the frame. The pad is operable to damp any vibrations of the frame and prevent or minimize transfer of such vibrations to the tread board. Since a passenger's feet contact only the tread boards on the conveyor, the passengers will be subjected to minimal vibration and will experience maximum comfort in transit.

It is therefore an object of this invention to provide an improved escalator or moving walkway step which will lessen vibrations felt by a passenger standing on the step.

It is an additional object of this invention to provide an improved step of the character described which includes a tread board that is vibrationally isolated from the remainder of the step.

It is a further object of this invention to provide an improved step of the character described wherein the tread board is set in a step frame but isolated therefrom by an elastomeric pad.

These and other objects and advantages of the invention will become more readily apparent from the following detailed description of a preferred embodiment thereof when taken in conjunction with the accompanying drawings, in which:

BEST MODE FOR CARRYING OUT THE INVENTION

Figure 2:
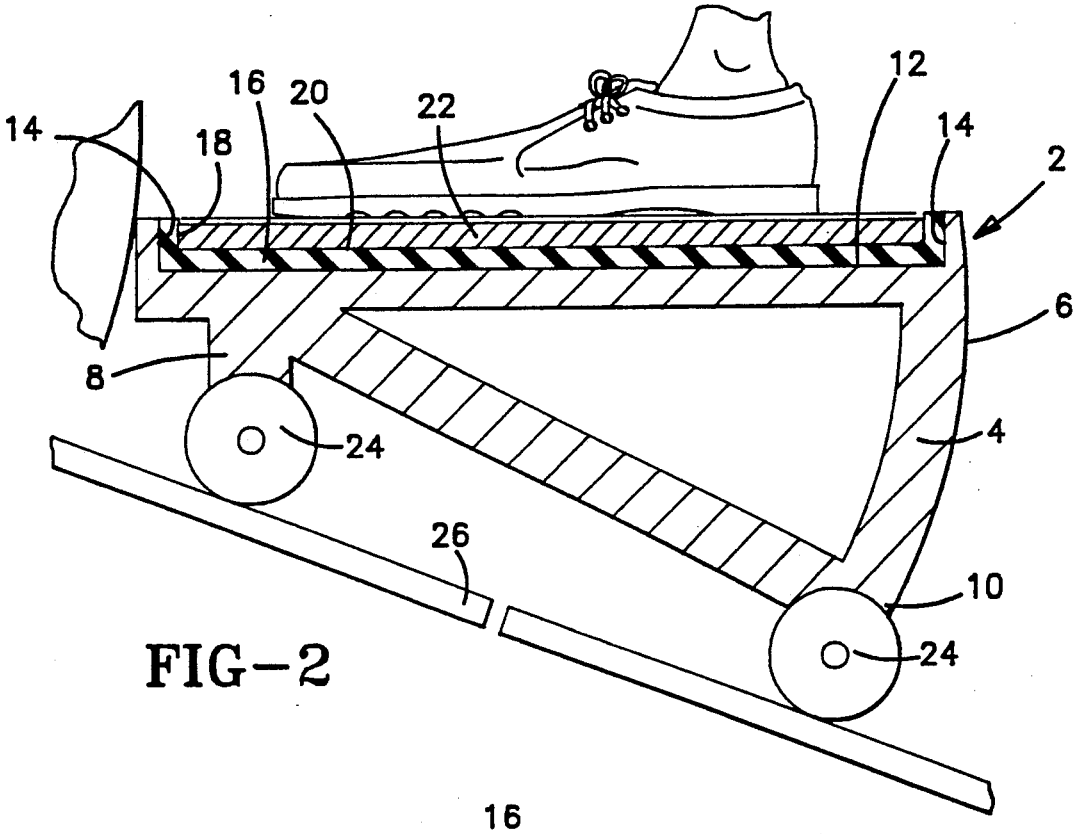
FIG. 2 is a sectional view of the step of FIG. 1 illustrating isolation of the tread board by the pad.
Figure 1:
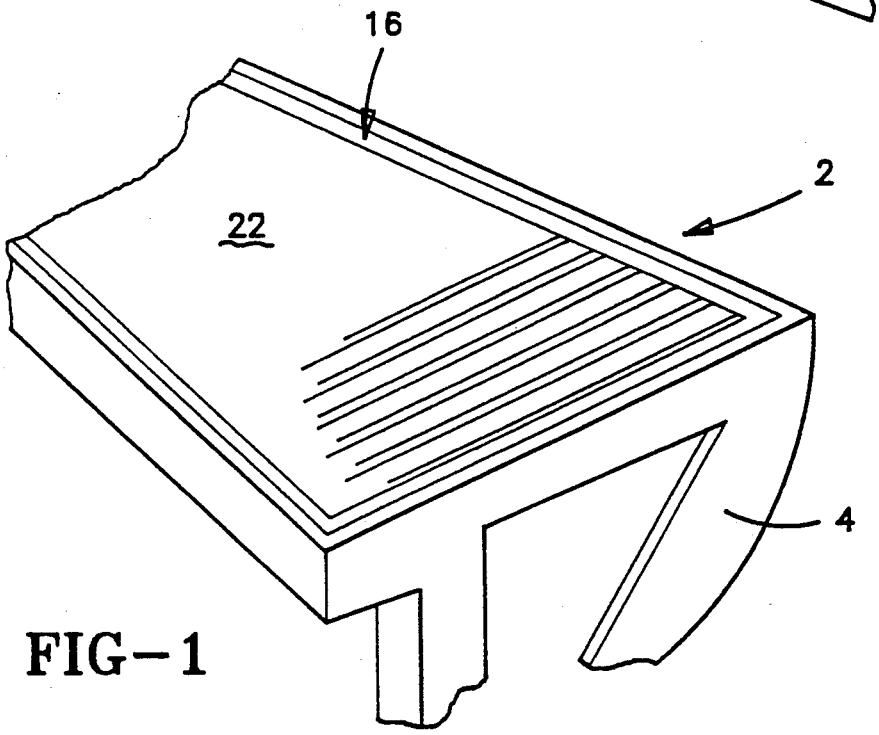
FIG. 1 is a fragmented perspective view of a step formed in accordance with the invention.

Referring to the drawings, the step is denoted generally by the numeral 2, and includes a frame 4 defining a riser 6, axle-mounting portions 8 and 10, and an upper surface defined by a recess 12. The recess 12 is rectangular in plan view and includes a peripheral wall 14. A liner 16 made from an elastomeric material such as rubber is disposed in the recess 12. The liner 16 has a side wall 18 which defines a pocket 20 in which the step tread board 22 is seated. The tread board 22 is completely isolated from the remainder of the step 2 by the liner 16. The tread board 22 will form about 95% of the top surface of the step 2 to ensure that the passengers' feet will not directly contact any of the remainder of the step 2. Isolation of the tread board 22 by the liner 16 ensures that little if any of the vibrations imposed on the step 2 through the step rollers 24 from the tracks 26 will be felt by a passenger standing on the tread board 22. While a continuous liner is shown, it will be appreciated that a plurality of smaller discrete members could be used if desired.

It will be readily appreciated that the escalator or moving walkway step assembly of this invention will provide a passenger with a smoother quieter ride without the need to modify other components of the conveyor. The step assembly is of simple construction, having minimal component parts, and is easy to assemble.

Since many changes and variations of the disclosed embodiment of this invention may be made without departing from the inventive concept, it is not intended to limit the invention otherwise than as required by the appended claims.

What is claimed is:

1. A step assembly for an escalator or moving walkway, said step assembly comprising: a frame having step roller axles connected thereto, said frame having a top surface defined in part by a recess having a bottom wall surrounded by side walls spaced inwardly of outer sides of said frame; rollers mounted on each of said axles, said rollers being operable to guide said step assembly over escalator or moving walkway tracks; elastomeric pad means mounted in said frame recess; and a tread board positioned on said pad means, said tread board forming the portion of said step assembly upon which passengers stand, and said tread board being completely isolated from said frame by said pad means whereby vibrations originating in said rollers or said frame are dissipated in said pad so as to isolate said tread board from such vibrations.

2. The step assembly of claim 1 wherein said pad means has a continuous bottom wall covering the bottom wall of said recess, and has continuous side walls covering said side walls of said recess whereby the only component of said step assembly contacted directly by said tread board is said pad means.

* * * * *